US007389894B2

(12) United States Patent
Danne et al.

(10) Patent No.: US 7,389,894 B2
(45) Date of Patent: Jun. 24, 2008

(54) DISPENSER FOR A CREAM-TYPE MATERIAL OR MATERIAL WHICH CAN BE DEPOSITED BY APPLYING IT TO A SURFACE

(75) Inventors: Ulrike Danne, Pulheim (DE); Norbert Hoefel, Duesseldorf (DE); Wolfgang Heukamp, Euskirchen (DE)

(73) Assignee: Henkel Kommanditgesellschaft Auf Aktien, Duesseldorf (DE)

( * ) Notice: Subject to any disclaimer, the term of this patent is extended or adjusted under 35 U.S.C. 154(b) by 456 days.

(21) Appl. No.: 10/476,292

(22) PCT Filed: Apr. 23, 2002

(86) PCT No.: PCT/EP02/04450

§ 371 (c)(1),
(2), (4) Date: May 25, 2004

(87) PCT Pub. No.: WO02/087384

PCT Pub. Date: Nov. 7, 2002

(65) Prior Publication Data

US 2004/0206783 A1 Oct. 21, 2004

(30) Foreign Application Priority Data

May 2, 2001 (DE) ..... 101 21 381

(51) Int. Cl.
*A45D 40/04* (2006.01)

(52) U.S. Cl. ..... 222/390; 401/68; 401/75; 401/175; 206/385

(58) Field of Classification Search ..... 222/390; 401/68, 69, 71, 74–78, 82–84, 172–175; 206/385

See application file for complete search history.

(56) References Cited

U.S. PATENT DOCUMENTS

| | | | | | |
|---|---|---|---|---|---|
| 1,664,166 | A | * | 3/1928 | Furedy | 401/30 |
| 3,589,821 | A | * | 6/1971 | Barney et al. | 401/75 |
| 5,172,993 | A | * | 12/1992 | Ackermann et al. | 401/69 |
| 5,653,338 | A | * | 8/1997 | Tani | 206/385 |
| 6,592,278 | B1 | | 7/2003 | Holthaus | 401/66 |

FOREIGN PATENT DOCUMENTS

| | | | |
|---|---|---|---|
| DE | 199 21 662 | A1 | 11/2000 |
| EP | 0 787 445 | B1 | 5/2001 |

OTHER PUBLICATIONS

PCT/EP02/04450 Search Report dated Jul. 22, 2002.

* cited by examiner

*Primary Examiner*—J. Casimer Jacyna
(74) *Attorney, Agent, or Firm*—Woodcock Washburn LLP

(57) ABSTRACT

Disclosed is a dispenser for a cream-type material or material which can be deposited by applying it to a surface, comprising a chamber with a discharge opening for receiving and storing said material, a spindle which is rotationally and longitudinally -axially arranged in the chamber, a piston which can move inside said chamber along the spindle by rotation thereof, and an operating element fixedly connected to the spindle for rotation, said spindle being provided with a least two regions having various thread pitches along the length thereof.

11 Claims, 4 Drawing Sheets

DISPENSER FOR A CREAM-TYPE MATERIAL OR MATERIAL WHICH CAN BE DEPOSITED BY APPLYING IT TO A SURFACE

This application is the U.S. National Phase of PCT/EP02/04450, filed Apr. 23, 2002, which claims priority to DE 10121381.6, filed May 2, 2001, the disclosure of which is incorporated herein by reference in its entirety.

This invention relates to a dispenser for a cream-form product or a product consumed by spreading over a surface comprising a space with an outlet opening for holding and storing the product, a spindle mounted longitudinally for rotation in the space, a piston designed for displacement along the spindle by rotation thereof in the space and an operating element fixedly connected to the spindle for rotation.

A dispenser of the type in question is known from applicants' DE 199 21 662 A1. In this known dispenser, the operating element for the spindle is formed by a gearwheel arranged outside the space and fixedly connected for rotation to the spindle and at least one operating button arranged on the dispenser with an integrally formed plunger element, the at least one operating button plus plunger element being arranged for movement from a rest position into an end position and back relative to the gearwheel in such a way that, when the operating button is operated from the rest position into the end position, the plunger element engages with a tooth of the gear wheel and turns the gearwheel. This dispenser is held in the hand of the user and at least one operating button is operated so that the spindle is turned through a predetermined angle and the piston is thus longitudinally displaced a certain distance towards the outlet opening and product can be dispensed from the dispenser. Dispensers of the type in question are used primarily for dispensing creams or as deodorant sticks.

The product is normally introduced into the dispenser itself, the piston being in its lowermost position. The dispenser is normally filled from above so that an empty space (dead space) is unavoidably formed in the upper part of the dispenser during the filling process. This dead space is determined in advance by the height of the dispenser and optionally by the shape—more particularly the curvature—of the applicator. This applicator, which is necessary when the dispenser is used for creams, is generally pressed on or screwed on. In addition, the dead space can also be caused by the product, i.e. the volume of product can decrease after filling, for example through air bubbles which escape after the filling process.

Because of this dead space between the outlet opening and the product, the operating button has to be repeatedly operated before the dispenser is used for the first time in order to move the product into the vicinity of the outlet opening because the spindle and the piston are designed so that, when the operating button is operated for the first time, the piston moves only slightly so that only a small exact dose of the product is dispensed. Accordingly, the actuation of the dispenser for the first time is very complicated for the user. With known dispensers of this type for cream-form products, for example, the operating button has to be pressed 50 to 60 times before product emerges for the first time.

In order to remedy this unsatisfactory situation, it would be possible in principle to increase the pitch of the spindle thread. However, this would have the adverse effect that, even after overcoming the dead space in the subsequent operation of the dispenser, the piston would be subsequently displaced a correspondingly large distance towards the outlet opening on operation of the operating button so that too much product would emerge. The small dose of product required from a single press of the operating button would no longer be possible to achieve.

Accordingly, the problem addressed by the present invention was to provide a solution which would considerably simplify dispensing of the product for the first time, but which would still ensure a small exact dose of product per dispensing operation after the product had been dispensed for the first time.

In a dispenser of the type mentioned at the beginning, the solution to this problem as provided by the invention is characterized in that, over its length, the spindle has at least two sections with different thread pitches.

The problem stated above can be solved with a dispenser designed in this way. Thus, the lower thread section of the spindle adjoining the operating element can have a greater thread pitch than the rest of the spindle with the result that, when the dispenser is used, the piston is moved with a greater advance towards the outlet opening when the operating element is operated for the first time, so that the dead space is quickly overcome. After the dead space has been overcome, the piston enters into the region of the spindle with the smaller thread pitch so that the small dose of product required is guaranteed to be dispensed without change for every single operation of the operating element. It is obvious that the piston has to be designed in such a way that it is suitable for co-operation with the particular threaded section of the spindle which can be achieved in different ways.

Besides the above-mentioned advantages, the dispenser according to the invention affords the possibility—where several spindle sections differing in pitch are provided—of longitudinally displacing the piston a different distance on its displacement path along the spindle for each single operation of the operating element, so that different doses can be dispensed. This can be useful, for example, when the product accommodated in the dispenser is in layers and/or consists of different constituents which are intended to be dispensed in different doses. In addition, by virtue of the greater pitch of the threaded spindle at the free end of the spindle, the displacement path of piston in the end section can be longer so that more product is dispensed at the end of the displacement path. This can be of advantage, for example, when the properties of the product deteriorate or diminish with time so that a relatively large dose of product is automatically dispensed when the dispenser is substantially empty.

In a particularly advantageous embodiment, the first section of the spindle located nearer the operating element has a greater thread pitch than the second section adjoining the first. In this way, the above-described problem of the dead space can be handily overcome by a small number of operations of the operating key when the dispenser is used for the first time.

Basically, different thread forms can be selected for the spindle including, for example, a trapezoidal thread, a sawtooth thread, a metric isothread, a Whitworth thread and the like. However, a round thread is particularly preferred.

If the spindle has two sections with different thread pitches in order to solve the problem of the dead space, the thread pitch of the first section may be between 9 and 12, preferably 9, while the thread pitch of the second section may be about 4.5.

In order readily to enable the piston to co-operate operatively with the different sections of the spindle, the piston is advantageously formed on its inside with stamped-out segments with differently inclined supporting surfaces for the thread pitches of the spindle. In a preferred embodiment, three to five segments are provided.

The stamped-out segments of the piston may have different shapes, for example rhombic or rectangular. In a particularly advantageous embodiment, they are rhombic in shape.

The invention is described in more detail in the following with reference to the accompanying drawings, wherein.

Figure 2:
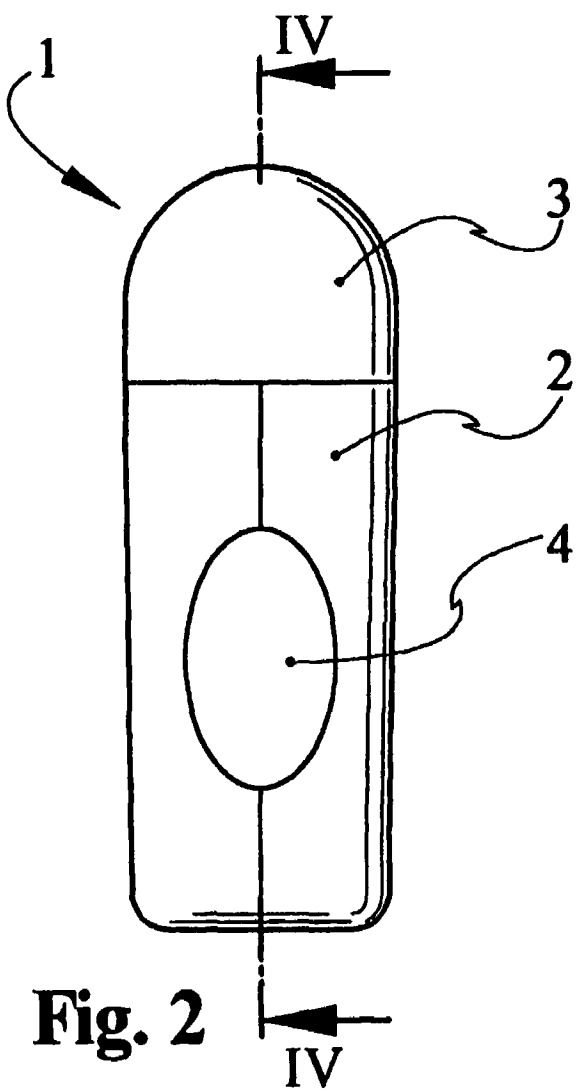
FIGS. 1 and 2 are side elevations of a dispenser according to the invention.
Figure 1:
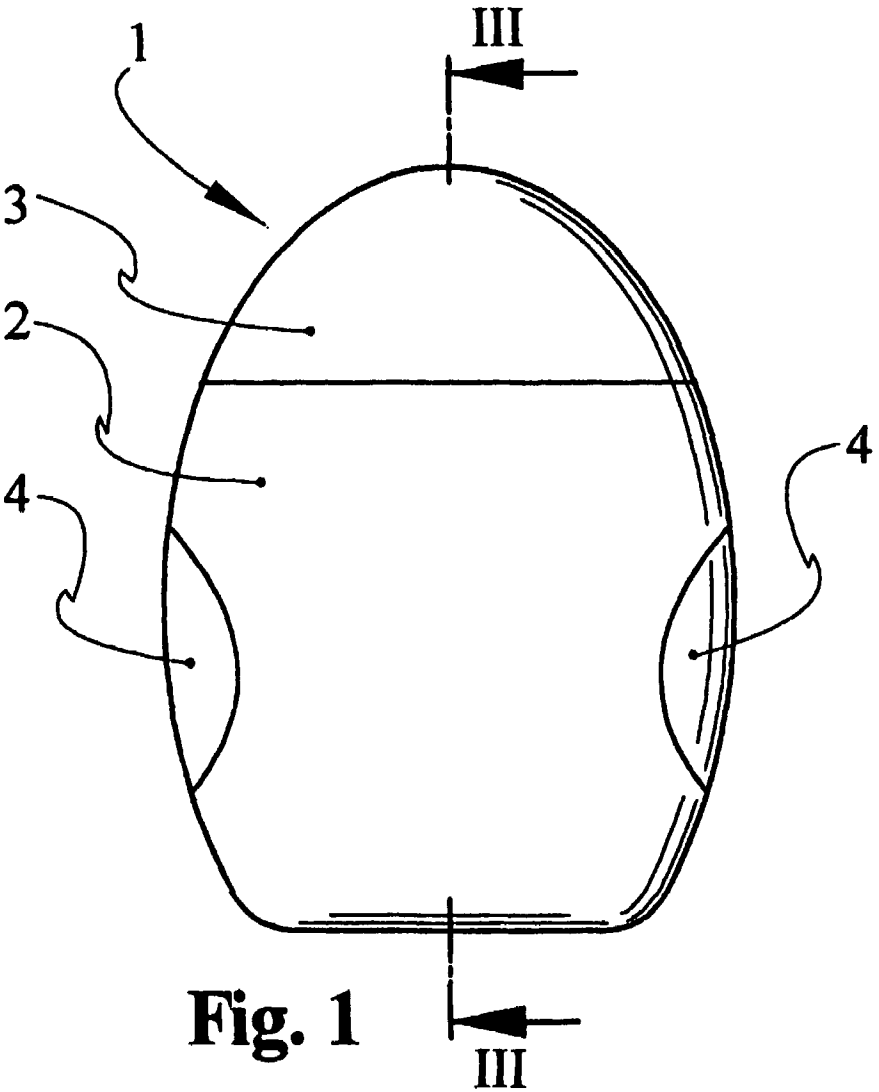

The dispenser denoted by the reference numeral 1 in FIGS. 1 and 2 comprises an outer housing 2 surmounted by a removable lid 3. In the embodiment illustrated, both the lid 3 and the housing 2 are oval in cross-section. In its sides, the housing 2 is formed with two diametrically opposite openings through each of which an operating button 4 extends from the inside of the dispenser 1. The surfaces of the operating buttons 4 extending through the openings are flush with, and continue the contours of, the adjoining outer surfaces of the housing 2.

Figure 4:
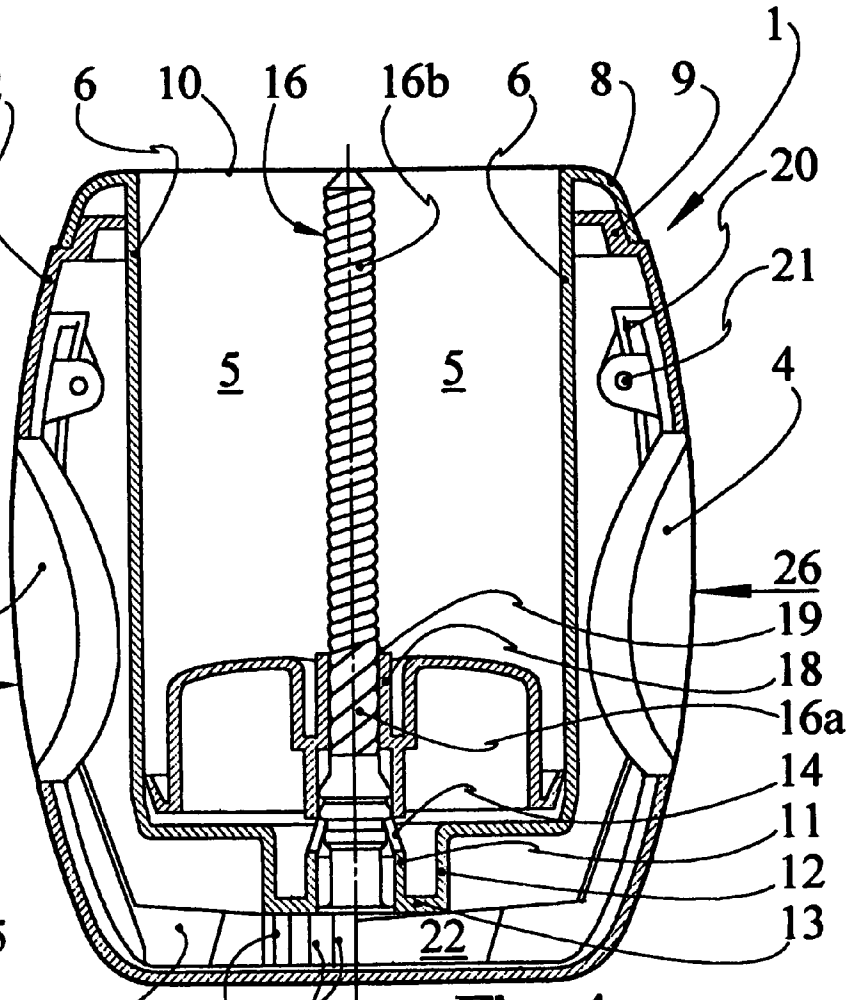
FIG. 4 is a section on the line IV-IV in FIG. 2.
Figure 3:
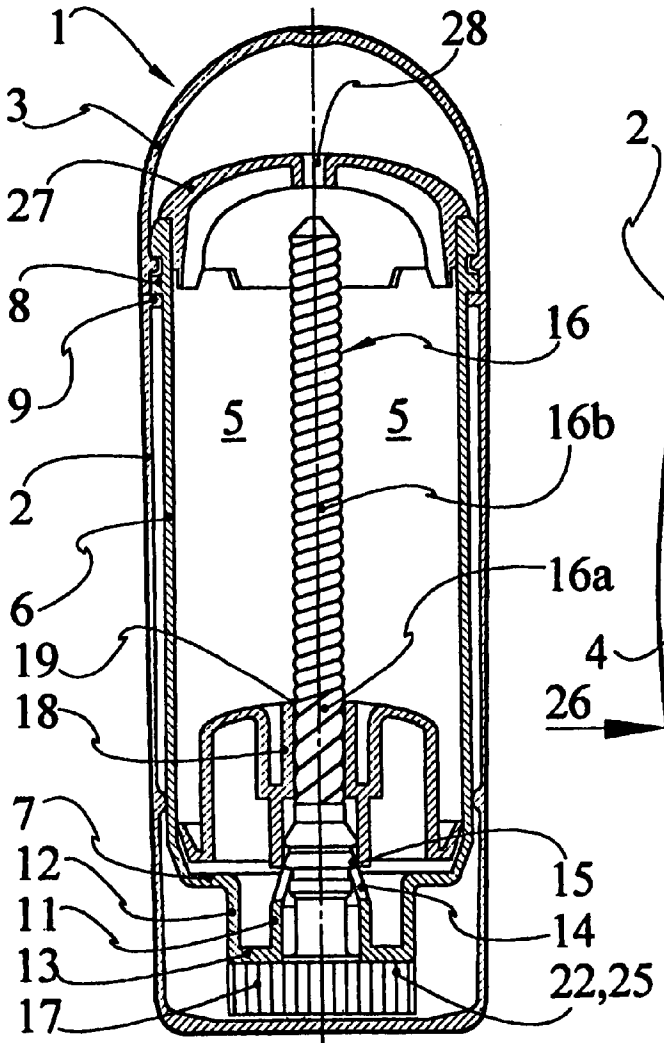
FIG. 3 is a section on the line III-III in FIG. 1.
Figure 5:
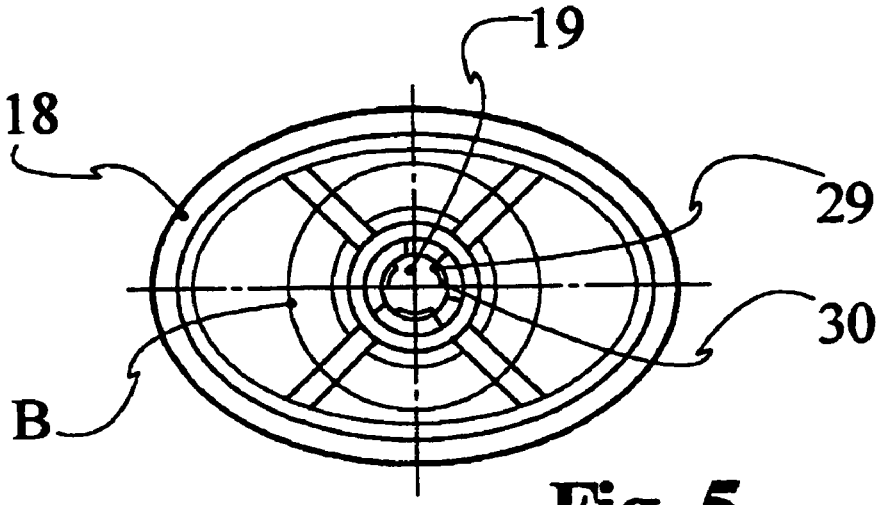
FIG. 5 is a plan view of the piston of the dispenser.
Figure 6:
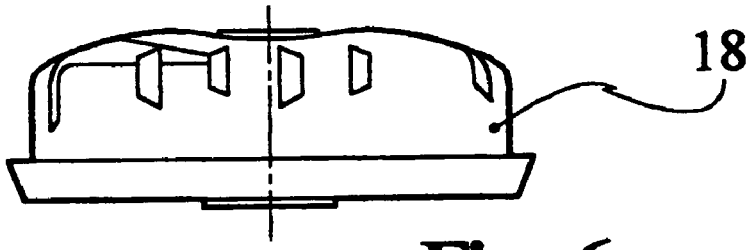
FIG. 6 is a side view of the piston.

As can best be seen from FIGS. 3 and 4, a space 5 is present in the housing 2. The space 5 is defined by side walls 6 also oval in cross-section and a bottom wall 7. On the side remote from the bottom wall 7, the sides 6 are integrally formed with an encircling projecting apron 8. The apron 8 is further away from the side walls 6 at its ends facing the operating buttons 4 than at its longitudinal sides. The apron 8 projects beyond an edge zone 9 of the outer housing 2 in such a way that the space 5 is thus fixed to the upper edge of the housing 2. The space 5 is thus inserted from above into the housing 2 comprising a base. The apron 8 surrounds an outlet opening 10 of the space 5.

An opening is formed in the center of the bottom wall 7. This opening is surrounded by a first cylinder wall 11. A second cylinder wall 12 surrounds the first cylinder wall 11 with a space in between, the first cylinder wall 11 and the second cylinder wall 12 being joined together by an annular bottom surface 13. The second cylinder wall 12 is joined to the bottom surface 7 of the space 5 so that the second cylinder wall 12 and the bottom surface 13 together form a cup-shaped recess in the bottom surface 7. A peripheral region 14 of the first cylinder wall 11 facing the space 5 is inclined slightly inwards and divided by notches into individual segments. These segments adjoin an undercut 15 of a spindle 16 which extends through the opening and the space 5 and is arranged longitudinally for rotation in the space 5. A gearwheel 17 is fixedly arranged for rotation on that side of the spindle 16 remote from the space 5, preferably being integrally formed with the spindle 16. The interval between the region of the undercut 15 and that face of the gearwheel 17 facing the space 5 is such that the spindle 16 is protected against longitudinal displacement by the peripheral zone 14 and the annular bottom surface 13 of the space 5.

A piston 18 is arranged inside the space 5 and has a central opening 19 with a screwthread (to be described in more detail hereinafter) by means of which it can be moved up and down in the space 5 by rotation of the spindle 16.

The operating buttons 4 comprise fixing elements 20 directed towards the outlet opening 10 which enable the operating buttons 4 to be fixed to the housing 2 in a manner that allows rotation about a pivot pin 21. The pivot pins 21 form the center of rotation of the lever-like operating buttons 4. The other side of the lever is formed by plunger elements 22 which are connected to the associated operating button 4 by a connecting element 23. The plunger elements 22 comprise a arm- or rod-like body integrally formed on the fixing elements 23. Integrally formed on the bodies is a lug 25 of which the tip faces the gearwheel 16 for engagement between individual teeth 24 of the gearwheel 16. Further away from the associated fixing elements 23 than the particular lug 25, a deflecting element is formed on the end of the particular plunger element 22 although this is not shown in detail in the drawing. Reference is made in this connection to the disclosure of DE 199 21 662 A1 which describes a similar design of the plunger element 22. Angled downwards, the deflector elements project from the surface of the plunger elements 22 in the opposite direction to the tip of the lug 25.

The operating buttons 4 with all their additional elements are preferably made in one piece of plastic. The arrangement and mounting of the operating buttons 4 on the pivot pin 21 connected to the outer housing 2 is such that, in the rest position of the operating buttons 4 shown in the drawings, the plunger elements 22 bear tangentially against the gearwheel 17, the lugs 25 engaging in the space formed between two teeth 24 of the gearwheel 17.

To operate the dispenser, the user presses the operating buttons 4 in the direction of the arrows 26. The plunger elements 22 are thus also moved in the direction of the arrows 26, come into contact through their lugs 25 with teeth 24 of the gearwheel 17 and turn it through a predetermined angle until the deflector elements contact the plunger deflectors and the plunger elements 22—by virtue of their inner elasticity—are deflected at the plunger deflectors so that the lugs 25 disengage from the teeth 24 of the gearwheel 16. Through the rotation of the gearwheel 17 by the movement from the rest position into the end position of the operating buttons 4, the spindle 15 fixedly connected for rotation to the gearwheel 17 is simultaneously rotated and moves the piston 18 a certain distance towards the outlet opening.

The outlet opening 10 is closed by a cover element 27 with a curved lid which bears sealingly against the side walls 6 through a flange-like edge region. In the illustrated embodiment, where it is designed for dispensing cream or gel, the cover element 27 is provided with an opening 28 through which product can emerge on operation of the dispenser. When the dispenser 1 is in the form of a deodorant stick, there is no opening 28 and the cover element 27 together with the lid 3 is removed from the outlet opening 10 or the housing 2 which then is preferably fixedly connected to the lid 3.

Figure 10:
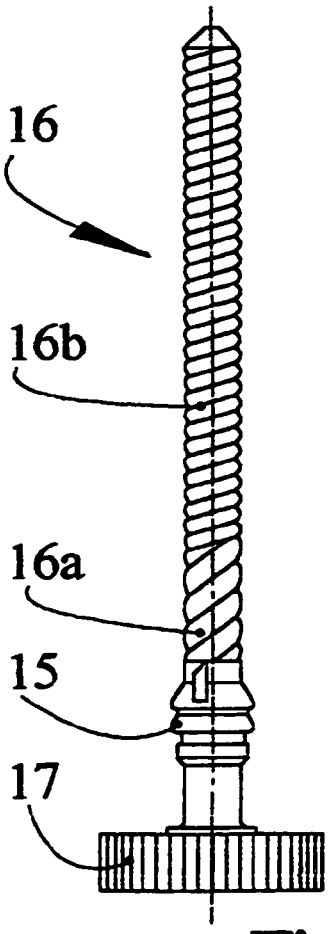
FIG. 10 shows the spindle of the dispenser.
Figure 11:
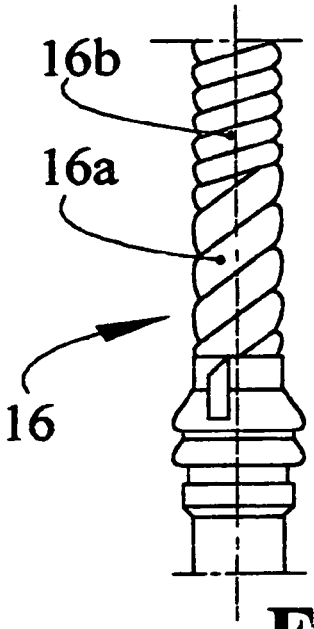
FIG. 11 shows the lower part of the spindle on an enlarged scale.

As can best be seen from FIGS. 10 and 11, the spindle 16 has at least two sections with different thread pitches over its length. In the illustrated embodiment, a first section with a greater thread pitch denoted by the reference numeral **16*a* is provided nearer the gearwheel 17 and is adjoined by a second section with a smaller thread pitch which is denoted by the reference numeral 16*b*. The threads are preferably round threads, the thread pitch of the first section 16*a* preferably being about 9 and that of the second section 16*b*** being about 4.5.

Figure 7:
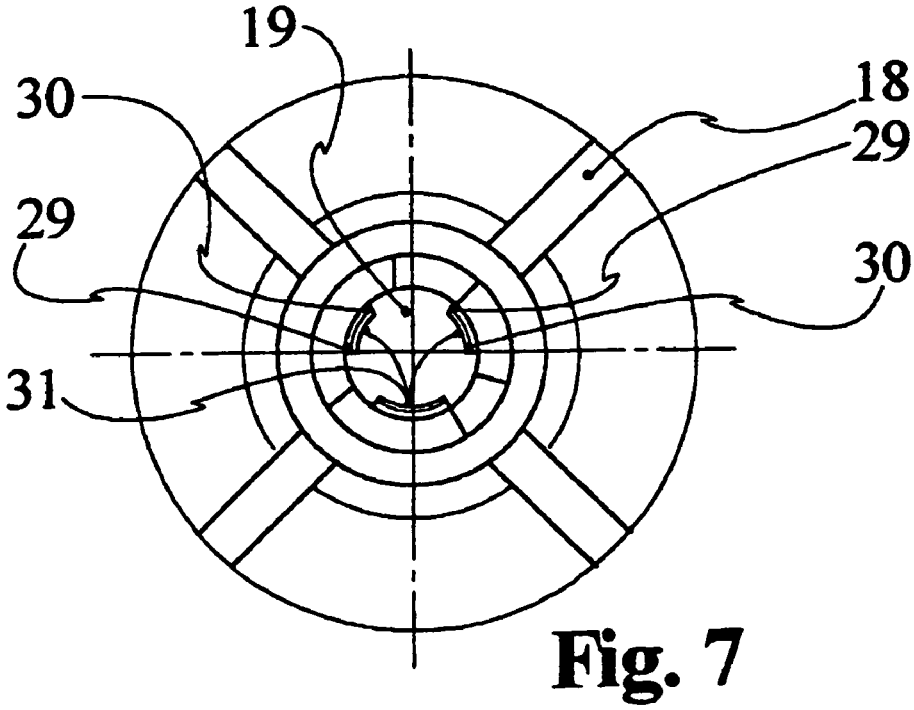
FIG. 7 shows detail B of FIG. 5 on an enlarged scale.
Figure 8:
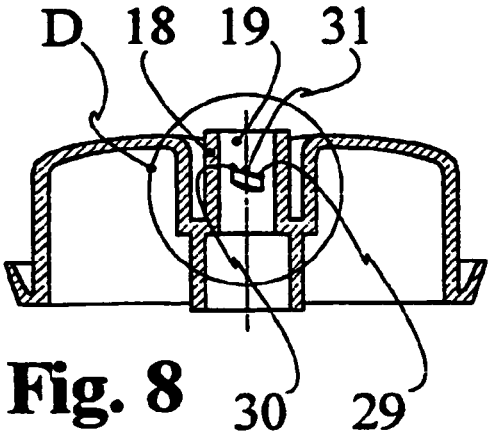
FIG. 8 is a longitudinal section through the piston.
Figure 9:
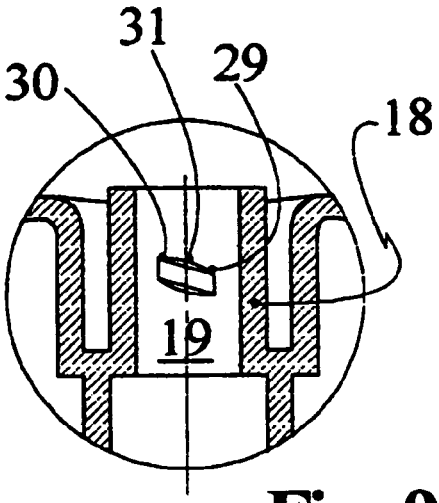
FIG. 9 shows detail D of FIG. 8 on an enlarged scale.

As can best be seen from FIGS. 7 to 9, three rhombic segments 31 formed by stamping out are provided in the opening 19 of the piston 18. These segments 31 have differently inclined supporting surfaces 29, 30 for the spindle sections **16*a*, 16*b*** with their different thread pitches.

This design of the spindle mechanism has the following advantage: The product to be accommodated in the space 5 is introduced into the upright dispenser through the removal opening 28. For various reasons, a dead space is unavoidably formed in the upper region beneath the cover element. The effect of this is that, when the dispenser 1 is used for the first time, the product is not dispensed, but is merely moved towards the opening 28. Because the spindle section 16*c* with the greater thread pitch is used first, the advance of the piston 18 is relatively large to begin with, so that the operating buttons 4 only have to be pressed a few times before product is dispensed for the first time. A defined displacement of the piston or a defined rotation of the spindle is produced by operation of the buttons. The piston 18 then passes into the second spindle section 16*b* with the smaller thread pitch and, with subsequent presses of the operating buttons 4, the piston 18 only advances a slight distance because the rotation of the spindle for each press of the buttons 4 is smaller due to the smaller thread pitch. In this way, only the small dose of product required is delivered per press.

The invention is not of course limited to the embodiment illustrated and other embodiments are possible without departing from the basic scope. Thus, the spindle 16 may be divided over its length into several sections with different thread pitches if, for example, different rates of advance are to be achieved, for example in the case of products composed of layers which have to be dispensed in different doses, etc. In addition, the operating element for the spindle 16 need not be formed by the operating buttons 4 and associated gearwheel, but may assume a different form, for example a wheel or the like.

The invention claimed is:

1. A dispenser for a cream-form product or a product consumed by spreading over a surface comprising a space with an outlet opening for holding and storing the product, a single-piece spindle mounted longitudinally for rotation in the space, wherein, over its length, the spindle has at least a first and a second section with different thread pitches, a piston supported on the spindle, the piston having a central opening defining an inner surface comprising protruding segments with differently inclined supporting surfaces for engaging the different thread pitches of the spindle, wherein the piston is designed for linear displacement along the spindle by rotation of the spindle in the space.

2. A dispenser as claimed in claim 1, wherein the first section of the spindle located nearer the operating element has a greater thread pitch than the second section adjoining the first section.

3. A dispenser as claimed in claim 1, wherein the first and second spindle sections each have a round thread.

4. A dispenser as claimed in claim 1, wherein the thread pitch of the first section is about 9 and that of the second section about 4.5.

5. A dispenser as claimed in claim 1, wherein the inner surface of the piston comprises three to five segments.

6. A dispenser as claimed in claim 1, wherein the protruding segments of the inner surface of the piston are rhombic in shape.

7. A dispenser as claimed in claim 2, wherein the the first and the second sections of the spindle each have a round thread.

8. A dispenser as claimed in claim 2, wherein the thread pitch of the first section is about 9 and that of the second section about 4.5.

9. A dispenser as claimed in claim 3, wherein the thread pitch of the first section is about 9 and that of the second section about 4.5.

10. A dispenser as claimed in claim 5, wherein the protruding segments of the inner surface of the piston are rhombic in shape.

11. A dispenser as claimed in claim 1, wherein the spindle has a substantially constant diameter.

* * * * *